United States Patent [19]

Croxton

[11] 4,231,124

[45] Nov. 4, 1980

[54] HOSPITAL BEDS

[75] Inventor: John M. Croxton, Birmingham, England

[73] Assignee: J. Nesbit-Evans & Co. Ltd., Wednesbury, England

[21] Appl. No.: 20,271

[22] Filed: Mar. 14, 1979

[30] Foreign Application Priority Data

Apr. 1, 1978 [GB] United Kingdom ..... 12843/78

[51] Int. Cl.[3] ..... A61G 7/00; A61G 7/10

[52] U.S. Cl. ..... 5/63; 5/62; 297/429

[58] Field of Search ..... 5/62, 63, 66; 297/429, 297/433

[56] References Cited

U.S. PATENT DOCUMENTS

| | | | |
|---|---|---|---|
| 2,604,140 | 7/1952 | Bursey | 297/429 |
| 3,189,385 | 6/1965 | Mommsen | 297/429 |
| 3,733,623 | 5/1973 | Croxton | 5/63 |

*Primary Examiner*—Casmir A. Nunberg
*Attorney, Agent, or Firm*—Marshall & Yeasting

[57] ABSTRACT

A hospital bed is described having a twin canting plate mechanical jack for raising the top of the bed relative to the base or chassis, for holding the top in any elevated position, and for permitting descent, in which the jack comprises a horizontally arranged main shaft which extends through the canting plates, with opposite ends of the shaft being connected to respective bell cranks of a linkage system which carries the bed top. A main shaft passes through a locking plate and a raising plate, and it is an important feature that a pedal shaft which effects displacement of the locking plate to allow the top to be lowered is also connected to the raising plate so that the raising plate locks the bed during the time that the locking plate is being moved to the release position so that subsequent descent of the bed top can be without jerk.

6 Claims, 4 Drawing Figures

HOSPITAL BEDS

This invention relates to mechanical jack systems particularly for use with hospital beds or trolleys of the kind for example as described in U.S. Pat. No. 3,733,623 issued May 22, 1973, in the name of John M. Croxton where the top or mattress support can be raised or lowered relative to the chassis or base of the bed or trolley, so as to reduce effort involved in nursing, and facilitate the patient entering or leaving the bed. This is because for many purposes a higher bed is convenient and avoids the necessity for the nurse to stoop, whilst for ingress or egress, particularly of the patient unaided, a low bed is more suitable.

The above U.S. Patent refers to the problem in using a hydraulic jack as the elevation means. It also refers to the previous problems in the substitution of a mechanical jack, namely that if the mechanical jack is of the continuous screw type, lowering is as laborious as raising, and if a canting plate type jack is used the descent tends to be jerky and not finely controlled. Said prior patent provides a solution to the problems, but in using an X-frame extending between the chassis and the top involves components of substantial dimensions in order to provide the required rigidity of the structure. In the light of the present invention this is seen to be expensive in terms of material content and unnecessarily heavy for the same reason.

Another type of hospital bed which is well known, and is also of the kind referred to, uses the chassis and the top as two parallel elements in a generally parallelogram linkage, the other two elements of the linkage being provided by swinging links pivoted at respective ends to the chassis and to the top. In practice, pairs of links are used at each end so that there is one such link towards each corner of the mattress support and chassis. This type is capable of providing the necessary rigidity with a much lighter weight, but it has been found that there are problems in providing satisfactory elevation means, and that the solution offered by the above U.S. patent is inconvenient, particularly in that if the canting plate jack of the above U.S. patent is provided at a generally mid-position along the length of the bed (as is the case in said patent) there is no possibility of mechanical advantage between jack movement and mattress movement and the raising operation is necessarily laborious; in addition, the possible range of movements is limited.

On the other hand, if the system of said prior patent were to be applied to one of the links of the parallelogram linkage, different problems arise, in particular the linkage would again have to be of relatively massive dimensions to accommodate the forces involved, and the location of the jack at effectively an extreme corner of the bed might also lead to problems with stability, especially when the bed is unoccupied or only lightly loaded.

The object of the present invention is to provide a construction of mechanical jack which is particularly (though not exclusively) suitable for use with the parallelogram linkage type of hospital bed or trolley.

The problem is solved by arranging, for the main shaft of a mechanical jack of the twin canting plate type to be coupled at opposite ends to the linkages at opposite ends of the bed so that the shaft is moved in one direction to raise the mattress support and in the other direction to lower the mattress support, the main shaft moving with one of the plates in each incremental raising movement, and relative to both of the plates in the lowering movement. Smooth and jerk-free descent is provided by arranging for the release member which releases the locking plate to be coupled to the raise plate additionally, so that the raise plate is moved into wedging position to lock the main shaft when the lock plate is released to the non-wedging position.

The invention is now more particularly described with reference to the accompanying drawings wherein.

Figure 1:
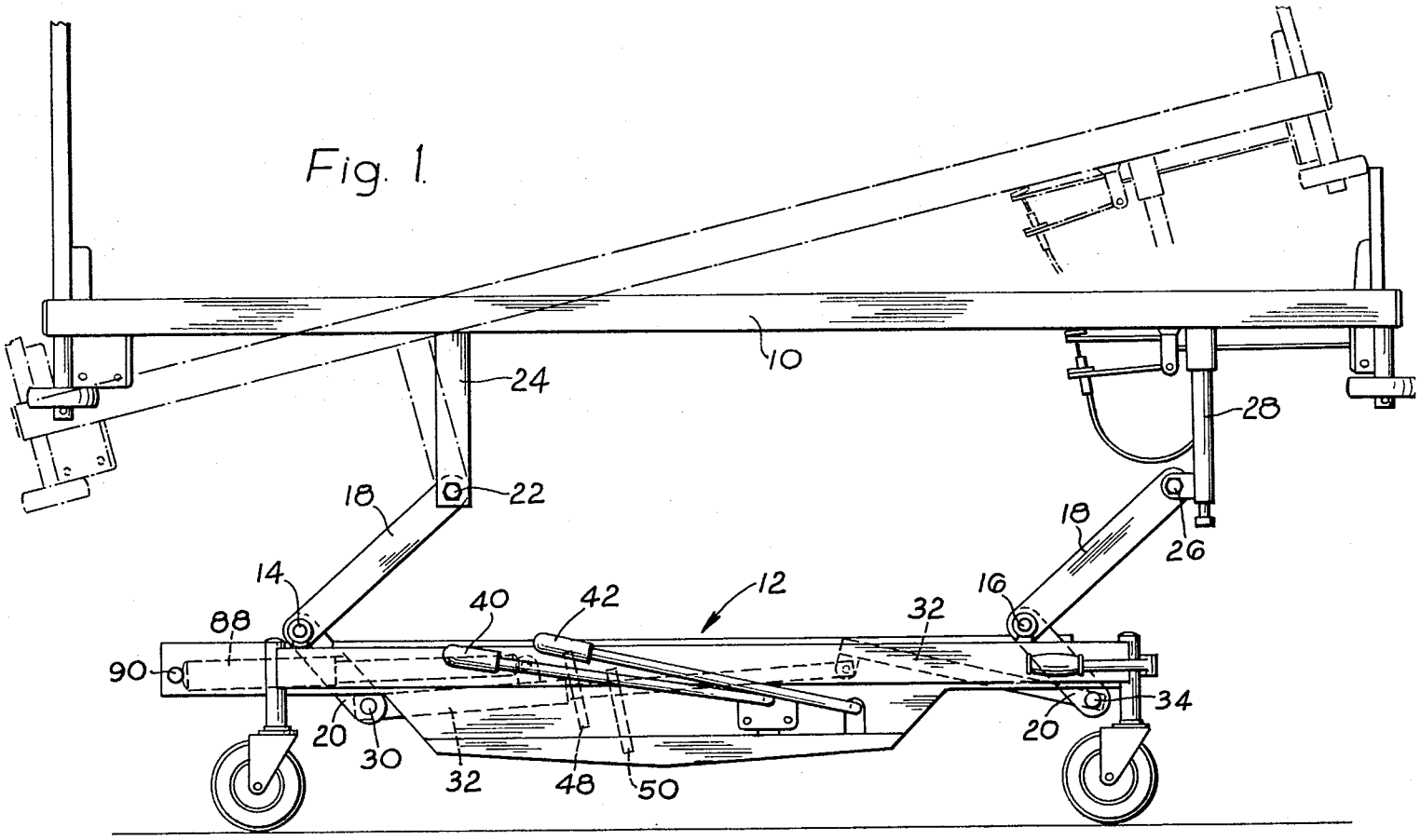
FIG. 1 shows a hospital bed in elevation, with the bed top shown in two alternative positions of tilt.
Figure 2:
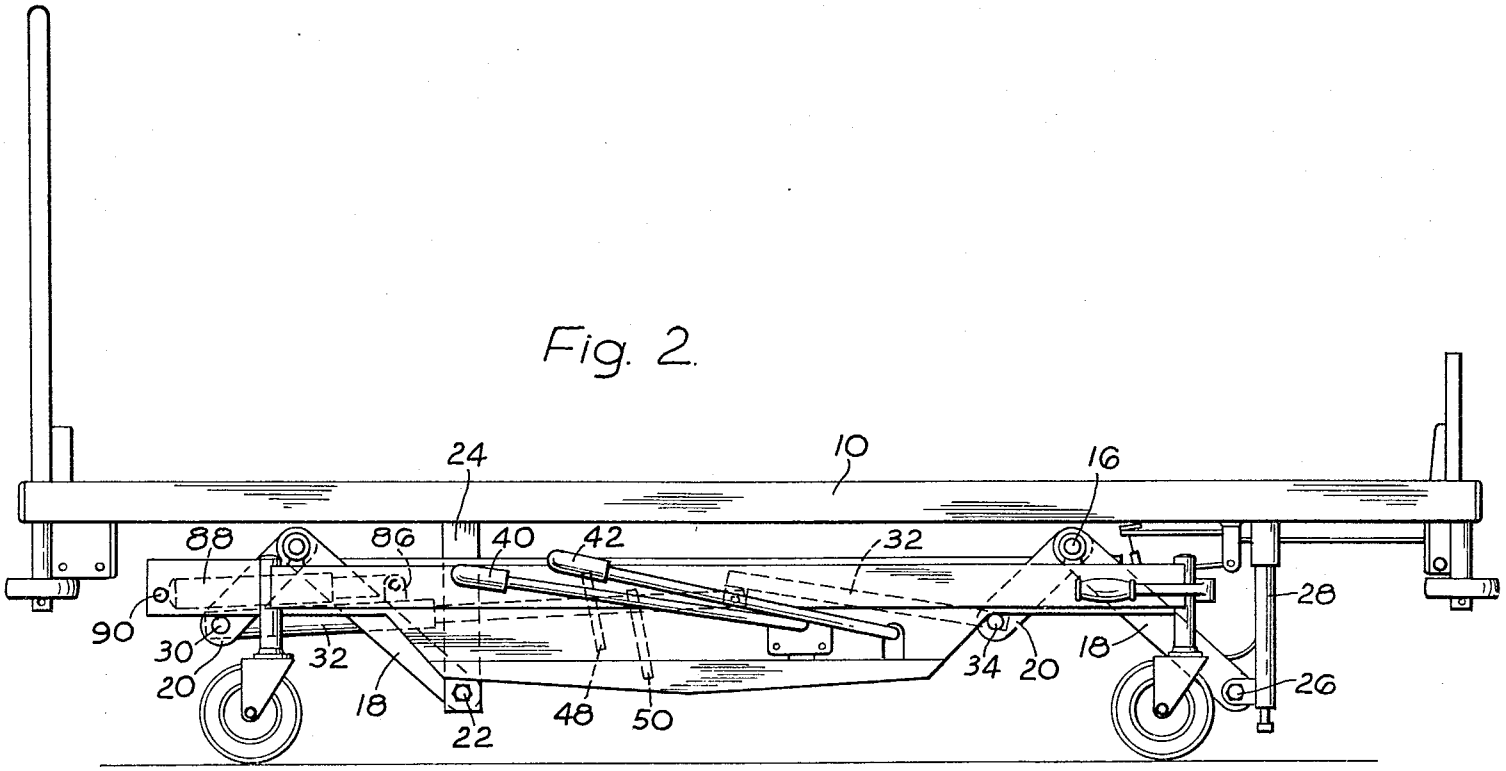
FIG. 2 is a view similar to FIG. 1, but showing the top or mattress support in a fully lowered position.

Turning now to the drawings, the bed shown in FIG. 1 comprises a top or mattress support 10 located above a base or chassis 12, and connected to the latter by two sets of linkages. Pivotal axis 14 is located at one end of the bed, for example the head end and pivotal axis 16 is located at the other, for example the foot end of the bed. These axes are fixed in relation to the chassis, and conveniently a pair of bell cranks is pivoted on the axis 14 and a second similar pair on the axis 16. As seen in FIG. 1, each of the bell cranks comprises an upwardly extending portion 18 and a downwardly extending portion 20, but in lowering of the bed from the FIG. 1 position to the FIG. 2 position the bell crank swings so that both portions become downwardly extending. In the case of the bell cranks located towards the head end of the bed, the portions 18 are pivoted about axis 22 to fixed brackets 24 carried by the top 10, but in the case of the linkages at the foot end of the bed, the corresponding pivotal axis 26 is afforded by a telescopically adjustable part 28, allowing the angle of the top 10 to be adjusted, for example between the full line position shown in FIG. 1 and the chain dot line position of the same view.

The bell crank limbs 20 at the head end are connected by a cross shaft 30 which is carried by one end of a main shaft 32, and the limbs 20 of the linkages at the opposite end of the bed are coupled to a second cross shaft 34 which is effectively coupled to the opposite end of the same main shaft 32. If and when the main shaft 32 is displaced longitudinally, the cross shafts 30 and 34 are moved towards the head end of the bed or towards the foot end of the bed as the case may be, the bell cranks swing about the axes 14 and 16, and the top 10 is raised or lowered.

Because cross shafts 30 and 34 swing in arcs about the axes 14 and 16, the shaft 32 does not, or may not move solely along its axis during such movements of the top 10, and various expedients are possible to accommodate the non-linear movements of the shaft 32. The preferred arrangement is as illustrated in the drawings, where the shaft 32 comprises at least two main parts which are pivoted together about the axis 36 (FIG. 3) so that the two parts of the main shaft can pivot relative to one another during the longitudinal movement of the main shaft.

Figure 3:
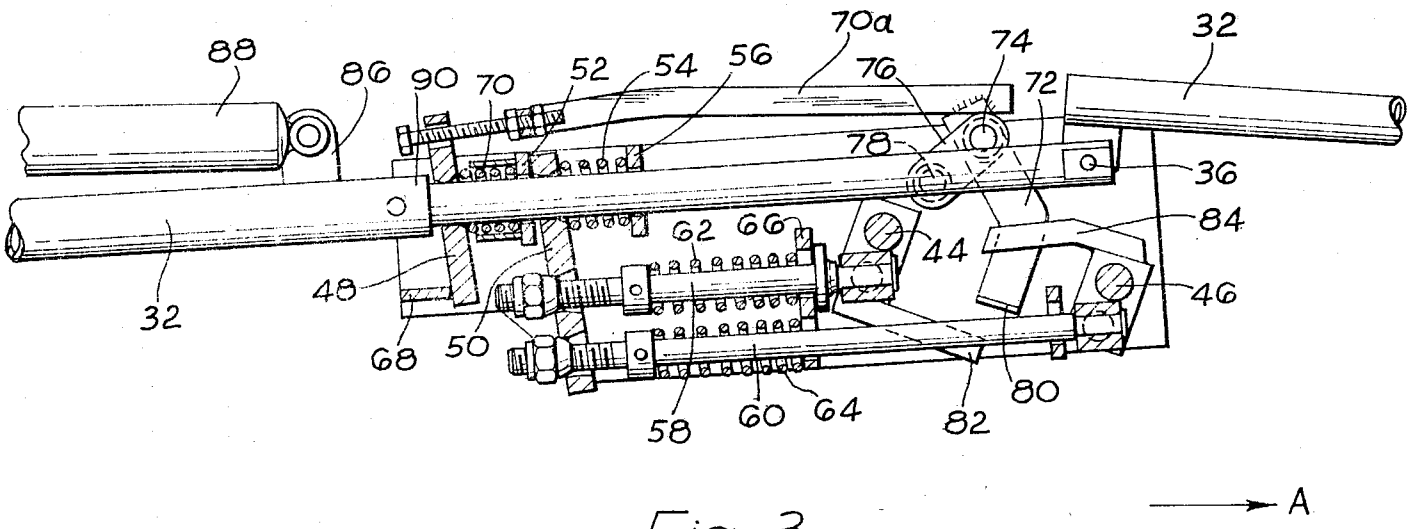
FIG. 3 is an elevation on an enlarged scale of the jack system used for raising and lowering the top of the bed.

Referring again to FIG. 1, the bed is provided with a pair of foot operated pedals 40, 42, each carried at the free end of a corresponding crank extension of a respective transverse shaft 44, 46 (FIG. 3). Shaft 44 is arranged for raising the bed top, e.g. from the FIG. 2 position to the FIG. 1 position, and shaft 46 for lowering the bed top.

The main shaft 32 is threaded through a pair of canting plates 48, 50. Plate 50 rests at its upper end against an abutment 52 and is urged by a spring 54 trapped against a second abutment 56. The plate is also coupled to a pair of tie rods 58, 60, each of which is urged by a compression spring 62, 64 which extends between a corresponding abutment on the rod and a second and fixed abutment 66. The rod 58 is coupled (via a pivot) to a crank fast with the pedal shaft 44 and the rod 60 is similarly coupled to a crank extension on the pedal shaft 46.

The basic operation of the bed raising mechanism can now be described. When the pedal 40 is moved anti-clockwise in FIG. 1 about the pedal shaft 44 axis (FIG. 3) the tie rod 58 pulls the plate 50 to a greater inclination relative to the axis of the main shaft 32 so as to wedge the plate on the shaft 32, and the plate in the wedged position is then moved relative to the shaft axis and with the shaft 32 in the direction of the arrow A of FIG. 3. This swings the bell crank portions 20 anti-clockwise about their pivots 14 and 16 and thus displaces the top 10 incrementally in the upward direction. At the end of the movement, the spring 62 returns the tie rod 58 and hence the pedal to the start position ready for a repeat stroke, and after a number of strokes the bed top is elevated to the required height.

To prevent the shaft 32 returning, in the opposite direction to that of arrow A in FIG. 3 during the return stroke of the pedal between each two operating strokes, the second plate 48 acts as a lock. This plate 48 rests against the fixed abutment 68 at its lower end (in the Figure) and is urged by a spring 70 which also sits against abutment 52. The plate 48 is thereby held in a locking wedge position, but the locking effect of the plate 48 is effectively uni-directional, in that it is effective at this time to prevent the shaft 32 being moved in the direction opposite to that of the arrow A of FIG. 3 but permits movement in the direction of the arrow A. Hence the shaft 32 is moved by the plate 50 to raise the bed, and is held by the plate 48 at the end of the incremental stroke and until a further incremental stroke commences.

The plate 48 is connected to an operating member 70*a* which is fast with an extension 72, and the extension 72 is pivoted at 74, on a swinging link 76 pivoted at 78 on a fixed axis.

The fixed axis 78 together with the various fixed abutments 68, 52, 56 and 66 are all carried by a jack body part, which may be a sheet metal pressing or the like carried by the chassis 12. The body part also provides journals for the shafts 44 and 46.

The extension 72 is provided with a lateral lug 80 which is associated with parts provided on both of the pedal shaft cranks. A lug 82 carried by the shaft 44 is arranged so that in the pedal 40 operation for raising the top of the bed the lug 82 moves into contact with the part 80 (if the latter is in the FIG. 4 position) and displaces it to the FIG. 3 position. The link 76 is conveniently provided with friction washers, such as spring loaded nylon washers about each of the pivotal axes 74, 78 so as to hold the part 72 and hence the part 80 in either displaced position (the FIG. 3 position or the FIG. 4 position), and the link 76 may travel over-centre so that pivot axis 74 is below a horizontal plane containing axis 78 to hold the parts in this position.

The pedal shaft 46 is provided with an abutment 84 which is located on the opposite side of the part 80 to the part 82. In movement of the pedal 42 for lowering the bed, the pedal travel causes the part 84 to contact the part 80 and displace it from the FIG. 3 position to the FIG. 4 position and in so doing move the operating member 70*a* position to a non-locking position.

It is important that operation of the release pedal 42 displaces the rod 60 so as to move the raise plate 50 to the wedge and lock position on the main shaft 32. Hence when the release pedal is operated, the action is to move the plate 50 so that it tends to displace shaft 32 in the direction of arrow A and thus lift the bed top incrementally, or at least move the parts to the position in which such a lifting movement is about to commence, before the plate 48 is moved to the release position. When the release pedal 42 is relieved, so that spring 64 returns the pedal 42 to the start position spring 54 returns the plate 50 to a position in which it is no longer lock engaged with the main shaft 32, and the main shaft 32 is then free to move to the left as shown in FIG. 3 and allow the bed to descend under the weight of the bed top (plus the occupant of the bed). This is particularly important in allowing smooth descent without a jerk such as would be likely if the release plate 38 were moved to the position where the shaft 323 is free to move to the left without it being held (temporarily) the the raise plate 50.

The main shaft 32 is coupled by lug 86 to one end of a damper strut 88 (of which the opposite end is fixed to the chassis at 90 in FIG. 2) and during movement of the main shaft the strut is extended in length or contracted in length according to the direction of movement. During the contraction which is involved in descent of the bed top, oil, gas or fluid circulates internally in the strut and provides a controlled descent because of the resistance to the circulation.

Figure 4:
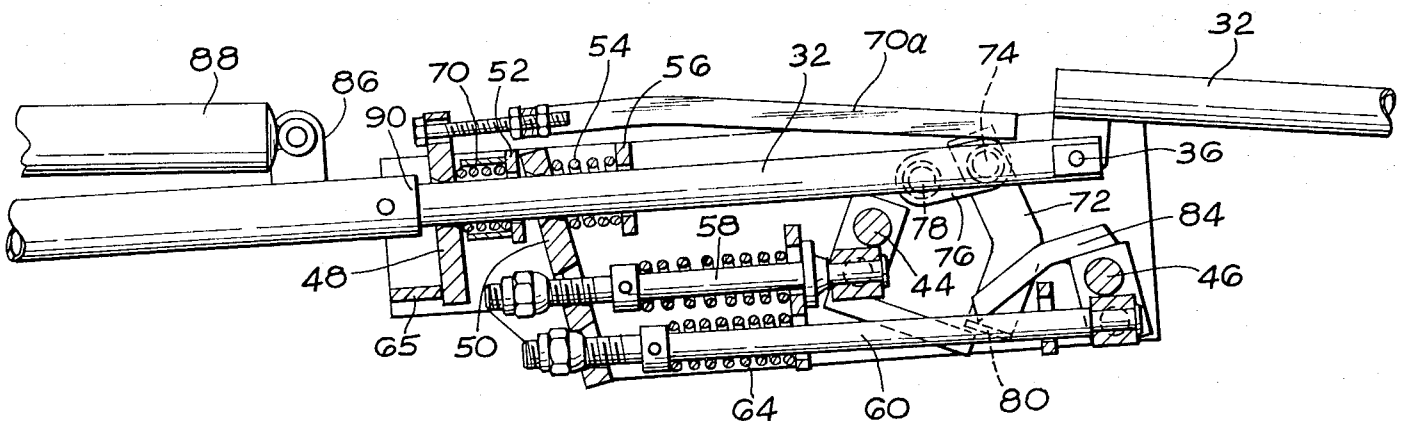
FIG. 4 is a view similar to FIG. 3 but showing the parts in different positions.

It will be appreciated that FIGS. 3 and 4 show the mechanism in a position where the bed top has been elevated to a maximum and the enlarged portion of the main shaft 32 in the vicinity of the reference 90 has closely approached the plate 48.

I claim:

1. A mechanical jack system comprising a main shaft extending through a pair of first and second canting plates of which the first plate is arranged to be displaced with the main shaft by a first operating member when said first plate is in wedging position on said main shaft to displace said shaft in one direction and the second plate is arranged to wedge the shaft against return movement, said second plate being arranged to be returned to a non-wedging position by a second operating member coupled to the second plate when return movement is required, characterised in that said second operating member is also coupled to said first plate so that the first plate is displaced at least to the wedging position on the main shaft when the second plate is to be released ready for the return movement.

2. A system as claimed in claim 1 characterised in that the two operating members are interconnected by an abutment system arranged so that movement of the first operating member displaces the abutment system to wedge the first plate on the shaft and movement of the second operating member releases the wedging of the second plate on the shaft.

3. A system as claimed in claim 1 or claim 2 characterised in that said main shaft is coupled to a damper unit which is carried by a fixed part so that displacement of the main shaft in the return direction is constrained by the damper.

4. A hopsital bed or the like comprising a base, a top, and two sets of swinging links disposed between the base and the top, said links being coupled to opposite ends of a main shaft of a mechanical jack system including said main shaft extending through a pair of first and second canting plates of which the first plate is arranged to be displaced with the main shaft by a first operating member when said first plate is in wedging position on said main shaft to displace said shaft in one direction and the second plate is arranged to wedge the shaft against return movement, said second plate being arranged to be returned to a non-wedging position by a second operating member coupled to the second plate when return movement is required, characterised in that said second operating member is also coupled to said first plate so that the first plate is displaced at least to the wedging position on the main shaft when the second plate is to be released ready for the return movement, movement of the main shaft in said one direction raising the top of the bed relative to said base and movement of the main shaft in said return movement lowering the top of the bed relative to said base.

5. A bed as claimed in claim 4 characterised in that two foot pedals are provided, each coupled to a corresponding one of the said operating members.

6. A bed as claimed in claim 4 or claim 5, characterised in that the main shaft comprises a pair of parts pivotally coupled end to end.

* * * * *

UNITED STATES PATENT OFFICE

CERTIFICATE OF CORRECTION

PATENT NO. : 4,231,124

DATED : November 4, 1980

INVENTOR(S) : JOHN M. CROXTON

It is certified that error appears in the above-identified patent and that said Letters Patent are hereby corrected as shown below:

Column 4 Line 7 before "position" insert
- so as to release the plate 48 from the wedge and locking- Signed and Sealed this

*Fourteenth* Day of *July 1981*

[SEAL]

*Attest:*

GERALD J. MOSSINGHOFF

*Attesting Officer*

*Commissioner of Patents and Trademarks*